US005411007A

United States Patent [19]

Narita

[11] Patent Number: 5,411,007

[45] Date of Patent: May 2, 1995

[54] AIR-FUEL RATIO CONTROL APPARATUS OF INTERNAL COMBUSTION ENGINE

[75] Inventor: Masaki Narita, Shizuoka, Japan

[73] Assignee: Suzuki Motor Corporation, Shizuoka, Japan

[21] Appl. No.: 171,065

[22] Filed: Dec. 21, 1993

[30] Foreign Application Priority Data

May 31, 1993 [JP] Japan ..... 5-152761
May 31, 1993 [JP] Japan ..... 5-152762
May 31, 1993 [JP] Japan ..... 5-152763

[51] Int. Cl.[6] ..... F02M 33/02

[52] U.S. Cl. ..... 123/690; 123/519; 123/520

[58] Field of Search ..... 123/690, 685, 519, 520, 123/516, 518, 198 D, 698, ; 73/117.3; 364/431.05, 431.01; 60/278

[56] References Cited

U.S. PATENT DOCUMENTS 4,391,130 7/1983 Nakano et al. ..... 73/117.3
5,060,621 10/1991 Cook et al. ..... 123/520
5,070,847 12/1991 Akiyama et al. ..... 123/690
5,126,943 6/1992 Nakaniwa ..... 364/431.05
5,195,495 3/1993 Kitamoto et al. ..... 123/520
5,197,450 3/1993 Kitajima et al. ..... 123/685
5,207,734 5/1993 Day et al. ..... 60/278
5,216,998 6/1993 Hosoda et al. ..... 123/698
5,230,319 7/1993 Otsuka et al. ..... 123/519
5,245,973 9/1993 Otsuka et al. ..... 123/519
5,349,934 9/1994 Miyano ..... 123/519
5,351,193 9/1994 Poirer et al. ..... 364/431.01

FOREIGN PATENT DOCUMENTS 4-153554 5/1992 Japan .
4-279755 10/1992 Japan .
4-362264 12/1992 Japan .

*Primary Examiner*—Raymond A. Nelli
*Attorney, Agent, or Firm*—Flynn, Thiel, Boutell & Tanis

[57] ABSTRACT

An air-fuel ratio control apparatus of an internal combustion engine in which a canister to adsorb and hold evaporated fuel is provided in a supply passage which communicates an intake passage of the internal combustion engine and a fuel tank, and an atmosphere opening/closing valve is provided so as to open the canister to the atmosphere. A purge valve is provided in the supply passage between the intake passage and the canister, and a pressure sensor communicates with the supply passage between the canister and the fuel tank. A control that closes the atmosphere opening/closing valve is closed when leakage is judged and reduces a pressure in the fuel tank to a predetermined negative pressure value, and thereafter closes the purge valve so that a leakage state of an evaporating system is discriminated. A fuel supply section is provided to supply the fuel to the internal combustion engine, and the control includes a control section for controlling in a manner such that when leakage judging conditions are satisfied, a preset promising correction amount is added to a fuel supply amount from the fuel supply section synchronously with the closing operation of the atmosphere opening/closing valve to thereby reduce fluctuation of the air-fuel ratio when the leakage is judged.

5 Claims, 7 Drawing Sheets

AIR-FUEL RATIO CONTROL APPARATUS OF INTERNAL COMBUSTION ENGINE

FIELD OF THE INVENTION

This invention relates to an air-fuel ratio control apparatus of an internal combustion engine and, more particularly, to an air-fuel ratio control apparatus in which a canister is provided in a passage which communicates an intake passage of the internal combustion engine and a fuel tank, an atmosphere opening/closing valve of the canister is closed, a pressure in the fuel tank is reduced to a predetermined negative pressure value, and after that, a purge valve is closed, and when a leakage state of the evaporating system is judged, a fluctuation of the air-fuel ratio can be reduced, deterioration of a drivability and an exhaust harmful component value can be prevented, and the apparatus can be advantageously realized in terms of costs.

BACKGROUND OF THE INVENTION

In an internal combustion engine installed in a vehicle or the like, evaporated fuel leaks into the atmosphere from a fuel tank, and a float chamber of a carburetor contains a large amount of hydrocarbons (HC) and is one of the causes of air pollution and also results in loss of fuel. Therefore, various techniques to prevent such problem are known. As a typical technique, there is an evaporating system (also referred to as an "evaporation fuel control apparatus") in which evaporated fuel in a fuel tank is adsorbed and held in a canister containing an adsorbent such as activated carbon or the like, and the evaporation fuel adsorbed and held in the canister is purged at the time of operation of the internal combustion engine and is supplied into the internal combustion engine.

The known evaporating system has: a canister which communicates with a fuel tank of the internal combustion engine by an introducing passage and communicates with an intake passage by a discharge passage; and a purge control valve is provided in the discharge passage. In the evaporating system, the purge control valve is opened or closed in accordance with the operating state of the engine and the evaporated fuel in the canister is purged into the intake passage and is combusted.

In the internal combustion engine having the above evaporating system, there is provided an air-fuel ratio control apparatus. The air-fuel ratio control apparatus controls an air-fuel ratio feedback value on the basis of a detection signal of an exhaust sensor provided in the exhaust passage, and a feedback control is executed so as to set an air-fuel ratio to a target value by making, for example, a fuel injection valve operative on the basis of the air-fuel feedback value.

As an air-fuel ratio control apparatus of an internal combustion engine, there is an apparatus disclosed in document JP-A-4-153554. A failure diagnosis apparatus of an evaporation purging system disclosed in the above document comprises: a control valve for diagnosis which is provided in an atmosphere release passage of a canister; pressure detecting means for detecting a pressure in the atmosphere release passage between the canister and the control valve; valve control means for respectively opening or closing the control valve for purge and for diagnosis at the time of diagnosis; and failure detecting means for detecting a failure of the system by comparing a pressure value detected by the pressure detecting means and a reference value upon diagnosis; and wherein the control valve for diagnosis is closed and a failure is detected when the control valve for purge is opened and when it is closed, respectively.

Further, an air-fuel ratio control apparatus is also disclosed in document JP-A-4-279755. According to this document, the apparatus has a fuel evaporation discharge suppressing apparatus and properly controls an air-fuel ratio of the mixture gas when shifting from a purge gas supply state to a shut-off state, thereby improving drivability of the engine and exhaust gas characteristics.

Further, there is further disclosed an air-fuel ratio control apparatus in document JP-A-4-362264. According to a failure diagnosis apparatus of an evaporation purging system disclosed in the above document, just after the start of the engine and when engine temperature is equal to or less than a predetermined value, a control valve for diagnosis is closed, a control valve for purge is opened, a negative pressure of an intake pipe is introduced to a vapor passage, and thereafter the control valve for purge is opened and this state is held for a predetermined time, thereby detecting a failure by a change in pressure value within the predetermined time.

In the conventional evaporating system for controlling the air-fuel ratio of an internal combustion engine, there is a system which judges leakage. That is, as leakage judging conditions, as shown in FIG. 10(*c*), an atmosphere opening/closing valve is set into a closing state and a pressure in the fuel tank is set to a negative pressure state up to a specified value (refer to FIG. 10(*a*)). As shown in FIG. 10(*b*), a purge duty is set to 0%, thereby detecting a pressure change in a predetermined time. In this instance, as shown by a broken line in FIG. 10(*a*), when the pressure change is large ($\Delta P_{yes}$), it is determined that leakage is occurring in the evaporating system. On the contrary, when there is no pressure change ($\Delta P_{no}$), it is determined that no leakage is occurring in the evaporating system.

In the judgment of the leakage, when the leakage judging conditions are satisfied, an atmosphere opening/closing valve provided in an atmosphere passage of the canister is closed, a purge control valve provided in a discharge passage is opened, and an intake negative pressure of an intake passage is introduced to the fuel tank side.

Subsequently, after the pressure in the fuel tank was set into a negative pressure state of a specified value by the intake negative pressure which is introduced, the purge control valve is closed, the fuel tank side of the purge control valve is held in a negative pressure state, a pressure $\Delta P$ in the fuel tank within a predetermined time is detected by a pressure sensor, and a leakage is discriminated by a change state of the pressure $\Delta P$ which is detected. As for the judgment, when a change in pressure $\Delta P$ is large, it is determined that there is leakage. When the change in pressure $\Delta P$ is small, it is decided that there is no leakage.

When a leakage occurs in the evaporating system, as shown in FIGS. 10(*d*) and 10(*e*), an air-fuel ratio feedback and an air-fuel ratio are large and suddenly change.

Therefore, when the external temperature (or fuel tank temperature) is high, a large quantity of evaporation occurs and, as shown in FIG. 10(*d*), the air-fuel ratio feedback is largely corrected to the negative side.

When the leakage judgment is executed in such a state, the evaporation is shut off by the closing operation of the atmosphere opening/closing valve. As shown in FIG. 10(*e*), the air-fuel ratio is largely deviated to the lean side.

At this time, there are inconveniences such that in the ordinary feedback control, trackability is bad, drivability is defective by making the air-fuel ratio lean, the exhaust gas purifying function deteriorates, and this is practically disadvantageous.

To eliminate the above inconveniences, the present invention provides an air-fuel ratio control apparatus of an internal combustion engine in which a canister to adsorb and hold evaporated fuel is provided in a passage which communicates an intake passage of the internal combustion engine and a fuel tank, an atmosphere opening/closing valve which operates so as to open said canister to the atmosphere is provided, a purge valve is provided in a passage between the intake passage and the canister, a pressure sensor communicates with the passage between the canister and the fuel tank, and when leakage is judged, the atmosphere opening/closing valve is closed and a pressure in the fuel tank is reduced to a predetermined negative pressure value, and thereafter the purge valve is closed and a leakage state of an evaporating system is discriminated, the improvement comprising a fuel supply section to supply fuel to the internal combustion engine is provided, and there is also provided a control section for controlling in a manner such that when leakage judging conditions are satisfied, a preset promising correction amount is added to a fuel supply amount from the fuel supply section synchronously with the closing operation of the atmosphere opening/closing valve, thereby reducing fluctuation of the air-fuel ratio when leakage is judged.

The invention also provides an air-fuel ratio control apparatus, as aforesaid, wherein the promising correction amount which has been preset by an atmospheric temperature is added to a fuel supply amount from the fuel supply section synchronously with the closing operation of said atmosphere opening/closing valve, and after the promising correction amount is added to the fuel supply amount and controlled, the fuel supply amount is gradually attenuated from the value added with the promising correction amount until the total fuel supply amount is less than a predetermined supply amount, thereby reducing fluctuation of the air-fuel ratio by the leakage judging operation.

The invention further provides an air-fuel ratio control apparatus, as aforesaid, wherein there is provided a control section for controlling in a manner such that a feedback correction amount before the leakage judgment is started is stored and, at the end of said leakage judgment, the correction amount is returned to the stored feedback correction amount before the start of the leakage judgment.

Further, the invention provides an air-fuel ratio control apparatus, as aforesaid, wherein there is provided a control section for controlling in a manner such that when leakage judging conditions are satisfied, a mean value of a feedback correction amount in a predetermined time before the closing operation of the atmosphere opening/closing valve is calculated and stored and, at the end of the leakage judgment, the feedback correction amount is forcedly set to said mean value.

The invention further provides an air-fuel ratio control apparatus, as aforesaid, wherein there is provided control means for controlling in a manner such that an air-fuel ratio feedback value is calculated on the basis of a detection signal of an exhaust sensor provided in the exhaust passage of the internal combustion engine, a feedback control is performed so as to set an air-fuel ratio to a target value, and simultaneously with the closing operation of the atmosphere opening/closing valve when the leakage judgment is executed by said evaporation fuel control apparatus, a feedback control is performed so that the air-fuel ratio is set to a target value by returning said air-fuel ratio feedback value to a reference value.

By the invention as mentioned above, when the leakage judging conditions are satisfied, the preset promising correction amount is added to the fuel supply amount from the fuel supply section synchronously with the closing operation of the atmosphere opening/closing valve by the control section, thereby controlling so as to reduce the fluctuation of the air-fuel ratio upon judgment of leakage. Deterioration of drivability is prevented, and deterioration of the exhaust gas purifying function is prevented.

The control section controls in a manner such that when the leakage judging conditions are satisfied, the promising correction amount which is preset by the atmospheric temperature is added to the fuel supply amount from the fuel supply section synchronously with the closing operation of the atmosphere opening/closing valve, and after the promising correction amount is added to the fuel supply amount and controlled, the fuel supply amount is gradually attenuated from the value to which the promising correction amount was added until the total fuel supply amount is less than a predetermined supply amount, and fluctuation of the air-fuel ratio by the leakage judging operation is reduced, thereby preventing deterioration of the drivability and the exhaust gas purifying function.

Further, the control section stores the feedback correction amount before the start of the leakage judgment and, upon completion of the leakage judgment, the correction amount is returned to the feedback correction amount before the start of the leakage judgment.

Further, the control section controls in a manner such that the mean value of the feedback correction amount within a predetermined time before the closing operation of the atmosphere opening/closing valve is calculated and stored when the leakage judging conditions are satisfied, and upon completion of the leakage judgment, the feedback correction amount is forcedly set to the mean value.

In the air-fuel ratio control apparatus of an internal combustion engine having the evaporation fuel control apparatus, a feedback control is executed by the control means so that the air-fuel ratio is set to a target value by calculating the air-fuel ratio feedback value on the basis of the detection signal of the exhaust sensor. A feedback control is executed by the evaporation fuel control apparatus so that the air-fuel ratio is set to a target value by returning the air-fuel ratio feedback value to the reference value simultaneously with the closing operation of the atmosphere opening/closing valve when the leakage judgment is performed. Due to this, in order to perform the leakage judgment, the atmosphere opening/closing valve is closed, the feedback control can be executed while promptly tracing the air-fuel ratio which was largely deviated to the lean side, and the fluctuation of the air-fuel ratio can be reduced.

An embodiment of the invention will now be described in detail hereinbelow with reference to the drawings.

DETAILED DESCRIPTION

Figure 1:
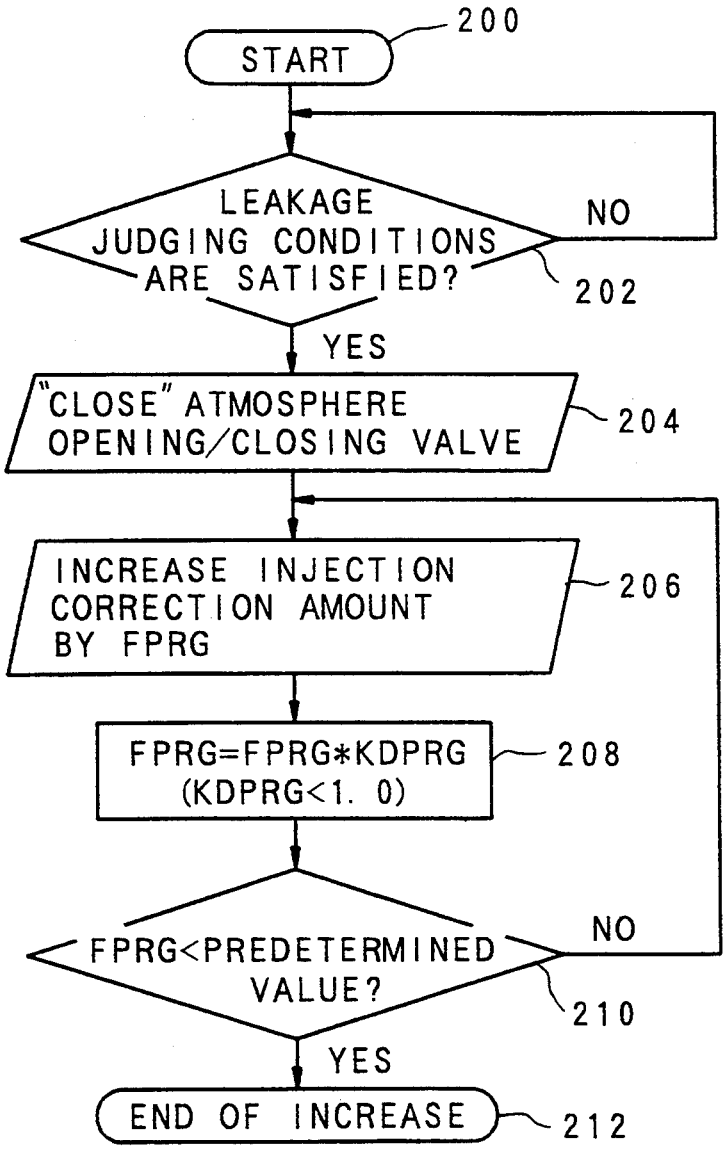
FIG. 1 is a flowchart for air-fuel ratio control of an air-fuel ratio control apparatus of an internal combustion engine showing an embodiment of the invention.
Figure 2:
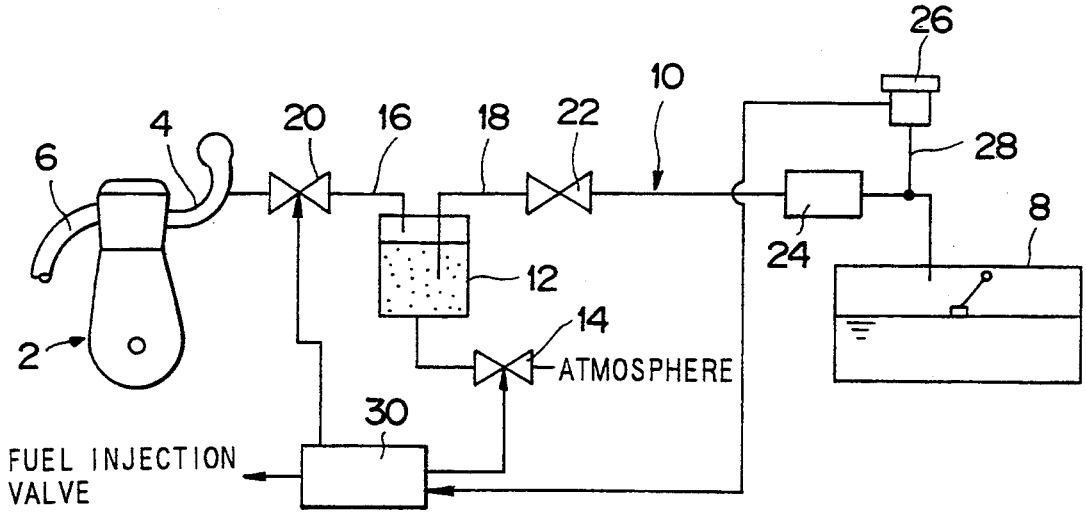
FIG. 2 is a schematic constructional diagram of an air-fuel ratio control apparatus of an internal combustion engine.
Figure 3:
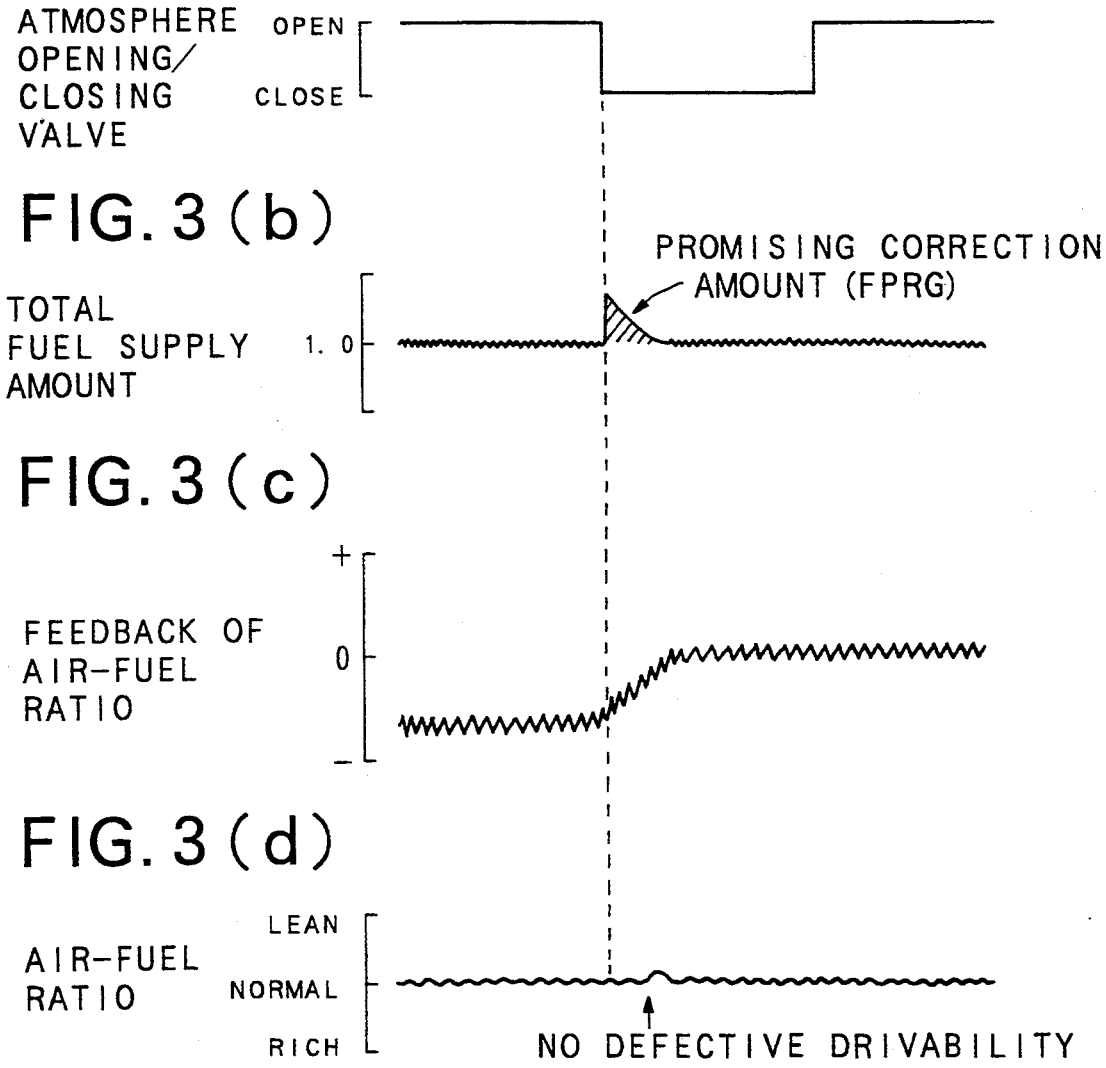
FIG. 3 is a time chart for air-fuel ratio control wherein FIG. 3(*a*) is a diagram showing an opening/-closing state of an atmosphere opening/closing valve, FIG. 3(*b*) is a diagram showing total fuel supply amount, FIG. 3(*c*) is a diagram showing an air-fuel ratio feedback state, and FIG. 3(*d*) is a diagram showing a rich/lean state of an air-fuel ratio.

FIGS. 1 to 3 show a first embodiment of the invention. In FIG. 2, reference numeral 2 denotes an internal combustion engine; 4 an intake passage; 6 an exhaust passage; and 8 a fuel tank.

In the engine 2, a fuel supply section is provided for the intake passage 4, for example, a fuel injection valve (not shown) is provided so as to be directed in the direction of a combustion chamber (not shown). The fuel injection valve communicates with the fuel tank 8 by a fuel passage (not shown).

Fuel in the fuel tank 8 is supplied to the fuel injection valve through the fuel passage by a fuel pump (not shown) and is supplied together with air to the combustion chamber and is combusted. The exhaust gas produced by the combustion is exhausted by the exhaust passage 6.

A passage 10 communicates between the fuel tank 8 and the intake passage 4, for example downstream from a throttle valve (not shown). A canister 12 which adsorbs and holds evaporated fuel is provided in the passage 10. An atmosphere opening/closing valve 14 to open the canister 12 to the atmosphere is provided.

The passage 10 is formed by: a first passage 16 which communicates between intake passage 4 and the canister 12; and a second passage 18 which communicates between the canister 12 and the fuel tank 8.

A purge valve 20 is provided in the first passage 16. A pressure control valve 22 and a separator 24 to separate gas and liquid are sequentially provided in the second passage 18 from the canister 12 side. A pressure sensor 26 communicates with the second passage 18 between the separator 24 and the fuel tank 8.

The pressure control valve 22 sets a pressure in the fuel tank 8 and a pressure in the canister 12 to predetermined pressures, thereby suppressing evaporation of hydrocarbons (HC) in the fuel tank 8. Further, the pressure sensor 26 connects to the second passage 18 through a pressure detecting passage 28 at a location between the pressure control valve 22 and the fuel tank 8.

Upon leakage judgment, the atmosphere opening/-closing valve 14 is closed and the pressure in the fuel tank 8 is reduced to a predetermined negative pressure value. After that, the purge valve 20 is closed and leakage state of the evaporating system is judged.

There is also provided a control section 30 for controlling in a manner such that when the leakage judging conditions are satisfied, a preset promising correction amount is added to the fuel supply amount from the fuel injection valve (not shown) synchronously with the closing operation of the atmosphere opening/closing valve 14, thereby reducing fluctuation of the air-fuel ratio at the time of leakage judgment.

In detail, as shown in FIG. 2, the fuel injection valve (not shown), fuel pump (not shown), atmosphere opening/closing valve 14, purge valve 20, and pressure sensor 26 are respectively connected to the control section 30. The control section 30 starts the control operation when predetermined leakage judging conditions are satisfied. The leakage judging conditions are set, for example, in the following manner in order to reduce influences on exhaust gas purification, drivability, and the like:

(1) Engine cooling water temperature $T_w$ is set to $T_w > T_{w1}$, where $T_{w1}$ is a predetermined water temperature, (2) Vehicle velocity V is set to $V_1 \leqq V \leqq V_2$, where $V_1$ is a first set vehicle velocity and $V_2$ is a second set vehicle velocity, (3) Vehicle velocity fluctuation $\Delta v$ in, for example, t seconds is set to $\Delta v < v$ for a predetermined time, where $v$ is a set vehicle velocity fluctuation, and (4) Tank inner pressure P in the fuel tank is set to $P > P_t$, where $P_t$ is a set tank inner pressure.

When all of the above conditions are satisfied, it is determined that the leakage judging conditions are satisfied.

When the leakage judging conditions are satisfied, the control section 30 controls in a manner such that the atmosphere opening/closing valve 14 is closed as shown in FIG. 3(*a*), a preset promising correction amount (FPRG) is added to an injection correction amount as a fuel supply amount from the fuel injection valve (not shown) synchronously with the closing operation of the atmosphere opening/closing valve 14 as shown in FIG. 3(*b*), and the fluctuation of the air-fuel ratio upon judgment of the leakage is reduced as shown in FIG. 3(*d*).

In this instance, the promising correction amount (FPRG) has been preset while using the ambient atmosphere temperature, namely, the fuel temperature (or intake air temperature, outside air temperature) and engine cooling water temperature as parameters.

The control section 30 also has a function such that after the promising correction amount is added to the injection correction amount and controlled, the attenuating process of the total fuel supply amount is executed until the value which is obtained by adding the promising correction amount to the injection correction amount of the fuel injection valve (not shown) as a total fuel supply amount is less than a predetermined supply amount, namely, until the promising correction amount is less than a predetermined value (refer to FIG. 3(*b*)).

According to the attenuating processing function, the value which is obtained by multiplying a predetermined attenuation ratio (KDPRG) to the promising correction amount (FPRG) is calculated as a new promising correction amount (FPRG), the new promising correction amount (FPRG) is added to the injection correction amount from the fuel injection valve (not shown), as shown in FIG. 3(*b*), the total fuel supply amount is gradually attenuated every injection from the value which was increased by only the promising correction amount (FPRG), thereby reducing fluctuation of the air-fuel ratio by the leakage judging operation.

The operation will now be described in accordance with the flowchart for air-fuel ratio control in FIG. 1.

In the starting operation of the internal combustion engine 2, a program of the flowchart for control is started at step 200 (start).

A check is made at step 202 to see if the leakage judging conditions are satisfied or not. Namely, (1) Engine cooling water temperature $T_w$ is set to $T_w > T_{w1}$, (2) Vehicle velocity V is set to $V_1 \leqq V \leqq V_2$, (3) Vehicle velocity fluctuation $\Delta v$ in, for example, t seconds is set to $\Delta v < v$ for a predetermined period of time, and (4) Tank inner pressure in the fuel tank is set to $P > P_t$.

If NO is the judgment at step 202, then the above discriminating process is repetitively executed until the answer in the judgment at step 202 is YES. If YES in the judgment at step 202, then the atmosphere opening/closing valve 14 is closed at step 204.

The promising correction amount (FPRG) is added to the injection correction amount from the fuel injection valve (not shown) synchronously with the closing operation of the atmosphere opening/closing valve 14, the total fuel supply amount is calculated, and the air-fuel ratio is controlled (step 206), thereby reducing the fluctuation of the air-fuel ratio upon judgment of the leakage.

After completion of the control by the total fuel supply amount obtained by adding the promising correction amount (FPRG) to the injection correction amount, the attenuating process is executed at the time of the next injection. Namely, the value obtained by multiplying the predetermined attenuation ratio (KDPRG) (KDPRG $<1.0$) to the promising correction amount (FPRG) is calculated as a new promising correction amount (FPRG), the new promising correction amount (FPRG) is added to the injection correction amount from the fuel injection valve (not shown), and as shown in FIG. 3(*b*), the total fuel supply amount is gradually attenuated every injection from the value which was increased by only the promising correction amount (FPRG) (step 208).

A further check is made at step 210 to see if the promising correction amount (FPRG) is less than a predetermined value or not. If NO in the judgment at step 210, the promising correction amount (FPRG) is added to the injection correction amount from the fuel injection valve (not shown), the total fuel supply amount is calculated, and the air-fuel ratio is controlled (step 206). If YES is the judgment (step 210), the control to increase the air-fuel ratio is finished (step 212).

Due to this, when the leakage judging conditions are satisfied, the preset promising correction amount is added to the fuel supply amount from the fuel supply section (not shown) by the control section 30 synchronously with the closing operation of the atmosphere opening/closing valve 14, thereby reducing the fluctuation of the air-fuel ratio upon judgment of the leakage. The deterioration of the drivability upon judgment of the leakage due to the deviation of the air-fuel ratio can be prevented. The deterioration of the exhaust gas purifying function due to the deviation of the air-fuel ratio can be also prevented.

After the promising correction amount is added to the fuel supply amount and controlled, the total fuel supply amount is gradually attenuated by the control section 30 from the value to which the promising correction amount was added until the total fuel supply amount is less than a predetermined supply amount. Thus, the fluctuation of the air-fuel ratio due to the leakage judging operation can be reduced. The deterioration of the drivability and the exhaust gas purifying function by the leakage judging operation due to the deviation of the air-fuel ratio can be prevented.

Further, by changing the control program in the control section 30, the apparatus can cope with the invention. Therefore, there is no need to increase the number of parts, the construction does not become complicated, the costs can be maintained low, and it is economically advantageous.

Figure 4:
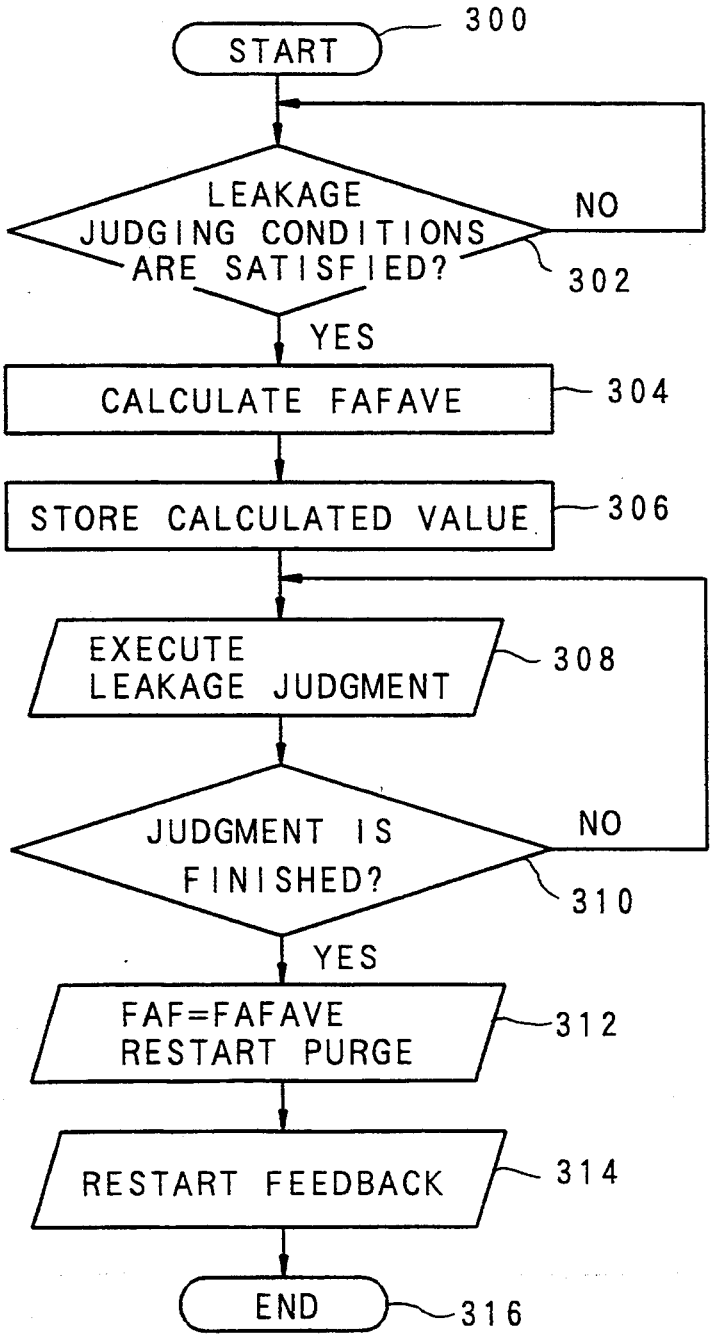
FIG. 4 is a flowchart of the air-fuel ratio control apparatus of the internal combustion engine showing an embodiment of the invention.
Figure 5:
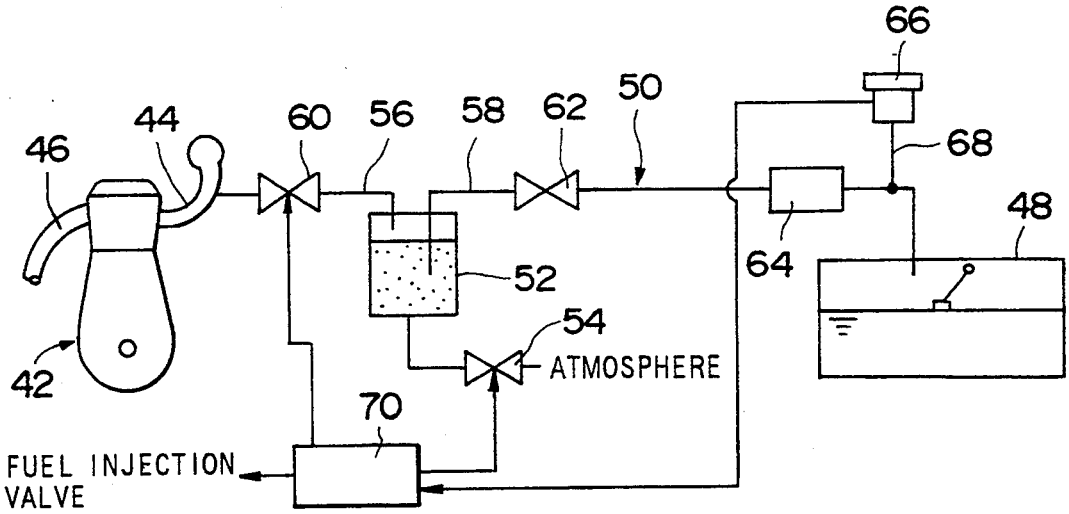
FIG. 5 is a schematic constructional diagram of an air-fuel ratio control apparatus of the internal combustion engine.
Figure 6:
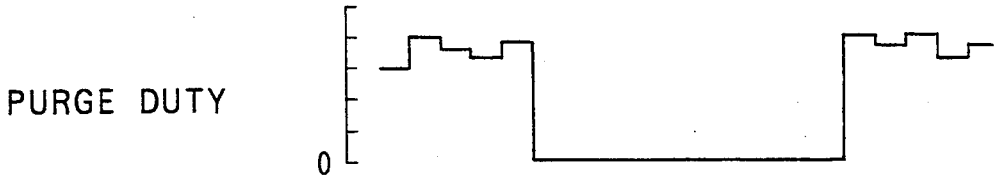
FIG. 6 is a time chart for air-fuel ratio control wherein FIG. 6(*a*) is a diagram showing a purge duty, FIG. 6(*b*) is a diagram showing an opening/closing state of an atmosphere opening/closing valve, FIG. 6(*c*) is a diagram showing an air-fuel ratio feedback state, and FIG. 6(*d*) is a diagram showing a rich/lean state of the air-fuel ratio.
Figure 6:
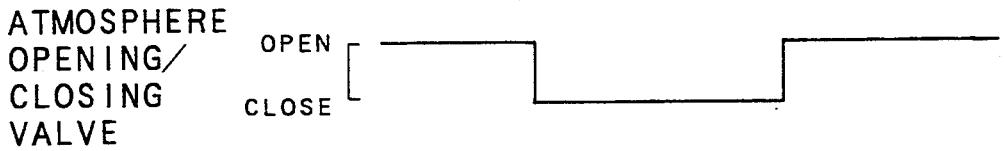
Figure 6:
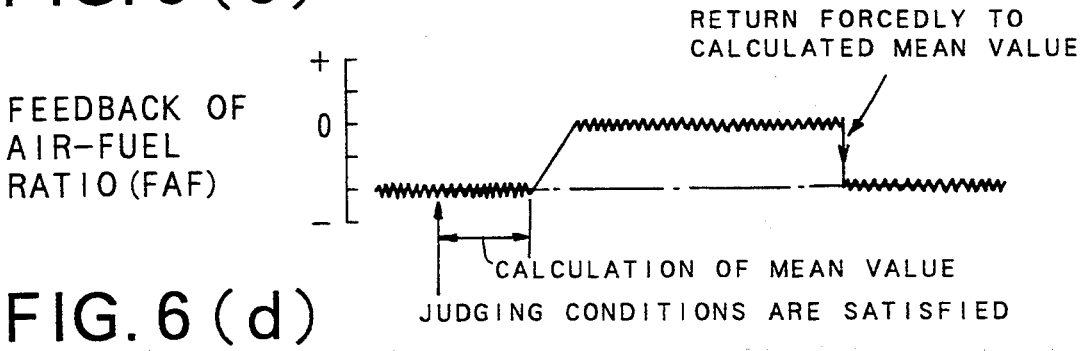
Figure 6:
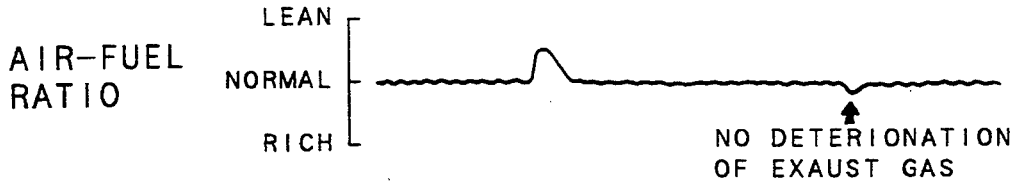

FIGS. 4 to 6 show a second embodiment of the invention.

In FIG. 5, reference numeral 42 denotes an internal combustion engine; 44 an intake passage; 46 an exhaust passage; and 48 a fuel tank.

In the internal combustion engine 42, a fuel supply section is provided for the intake passage 44, for example, a fuel injection valve (not shown) is provided for supplying fuel in the direction of a combustion chamber (not shown). The fuel injection valve communicates with the fuel tank 48 by a fuel passage (not shown).

The fuel in the fuel tank 48 is fed to the fuel injection valve through the fuel passage by a fuel pump (not shown) and is supplied together with air into the combustion chamber and is combusted. The exhaust gas produced by the combustion is exhausted by the exhaust passage 46.

A passage 50 is provided which communicates with the intake passage 44 of the internal combustion engine 42, for example, between the downstream side portion of a throttle valve (not shown) and the fuel tank 48. A canister 52 to adsorb and hold the evaporated fuel is provided in the passage 50. An atmosphere opening/closing valve 54 to release the canister 52 to the atmosphere is provided.

The passage 50 is formed by: a first passage 56 which communicates between the intake passage 44 and the canister 52; and a second passage 58 which communicates between the canister 52 and the fuel tank 48.

A purge valve 60 is provided in the first passage 56. A pressure control valve 62 and a separator 64 to separate the gas and the liquid are sequentially provided in the second passage 58 from the canister 52 side. A pressure sensor 66 communicates with the second passage 58 between the gas-liquid separating separator 64 and the fuel tank 48.

The pressure control valve 62 sets the pressure in the fuel tank 48 and the pressure in the canister 52 to predetermined pressures, thereby suppressing generation of amounts of hydrocarbons (HC) in the fuel tank 48.

Further, the pressure sensor 66 communicates with the second passage 58 through a pressure detecting passage 68.

Upon judgment of leakage, the atmosphere opening/-closing valve 54 is closed and the pressure in the fuel tank 48 is reduced to a predetermined negative pressure value. After that, the purge valve 60 is closed, thereby judging a leakage state of the evaporating system.

There is provided a control section 70 for controlling in a manner such that before the leakage judgment is started a feedback correction amount (FAF) is stored and, upon completion of the leakage judgment, the correction amount is returned to the stored feedback correction amount (FAF) before the leakage judgment is started.

The control section 70 controls in a manner such that when the leakage judging conditions are satisfied, a mean value (FAFAVE) of the feedback correction amount (FAF) within a predetermined time before the closing operation of the atmosphere opening/closing valve 14 is calculated and stored and, upon completion of the leakage judgment, the feedback correction amount (FAF) is forcedly set to the mean value (FAFAVE).

Explaining in detail, as shown in FIG. 5, the fuel injection valve (not shown), the atmosphere opening/-closing valve 54, purge valve 60, and pressure sensor 66 are connected to the control section 70, respectively.

When predetermined leakage judging conditions are satisfied, the control section 70 starts the control operation. However, the leakage judging conditions are set, for example, as shown below in order to reduce the influences on the exhaust gas purification, drivability, or the like.

(1) The engine cooling water temperature $T_w$ is set to $T_w > T_{w1}$, $T_{w1}$: predetermined water temperature (2) The vehicle velocity V is set to $V_1 \leqq V \leqq V_2$, $V_1$: first set vehicle velocity $V_2$: second set vehicle velocity (3) The vehicle velocity fluctuation $\Delta\upsilon$ in, for example, t seconds is set to $\Delta\upsilon < \upsilon$ for a predetermined time, $\upsilon$: set vehicle velocity fluctuation (4) The tank inner pressure P in the fuel tank is set to $P > P_t$, $P_t$: set tank inner pressure.

When all of the above conditions are satisfied, it is determined that the leakage judging conditions are satisfied.

When the leakage conditions are satisfied, the control section 70 calculates the mean value (FAFAVE) of the feedback correction amount (FAF) in a predetermined time before the closing operation of the atmosphere opening/closing valve 54 and stores as shown in FIG. 6(*c*) and subsequently sets a purge duty to 0% as shown in FIG. 6(*a*) and closes the atmosphere opening/closing valve 54 as shown in FIG. 6(*b*), thereby judging the leakage.

After completion of the leakage judgment, the control section 70 forcedly and rapidly changes the feedback correction amount (FAF) to the mean value (FAFAVE), thereby reducing the fluctuation of the air-fuel ratio at the end of the leakage.

The operation will now be described with reference to a flowchart for air-fuel ratio control in FIG. 4.

In the starting operation of the internal combustion engine 42, the program of the flowchart for control is started (START at step 300).

A check is made to see if the leakage judging conditions are satisfied or not (step 302). For example, a check is made to see if all of the following conditions are satisfied:

(1) The engine cooling water temperature $T_w$ is set to $T_w > T_{w1}$, (2) The vehicle velocity V is set to $V_1 \leqq V \leqq V_2$, (3) The vehicle velocity fluctuation $\Delta\upsilon$ in, for example, t seconds is set to $\Delta\upsilon < \upsilon$ for a predetermined time, and (4) The tank inner pressure P in the fuel tank is set to $P > P_t$.

If NO in the judgment at step 302, the above process is repetitively executed until the answer in the judgment is YES. If YES in the judgment (step 302), a process (step 304) to calculate the mean value (FAFAVE) of the feedback correction amount is executed. The calculation value obtained by the above calculation is stored (step 306).

The leakage judgment is executed (step 308). After that, a check is made to see if the leakage judgment has been finished or not (step 310). If NO in the judgment (step 310), the leakage judgment is executed (step 308).

If YES in the judgment (step 310), the feedback correction amount (FAF) is forcedly changed until the mean value (FAFAVE) of the feedback correction amount calculated by the process (step 304) and the purge is restarted (step 312).

The feedback control is restarted (step 314) and, after that, the program is finished (step 316).

Due to this, when the leakage judging conditions are satisfied, the fluctuation of the air-fuel ratio at the end of the leakage judgment can be reduced. The deterioration of the drivability due to the fluctuation of the air-fuel ratio can be prevented. The deterioration of the exhaust gas purifying function due to the fluctuation of the air-fuel ratio can be also prevented. This is practically advantageous.

On the other hand, by merely changing the control program in the control section 70, the apparatus can cope with the invention. Accordingly, there is no need to increase the number of parts. The construction does not become complicated. The costs can be maintained low. This is economically advantageous.

Figure 7:
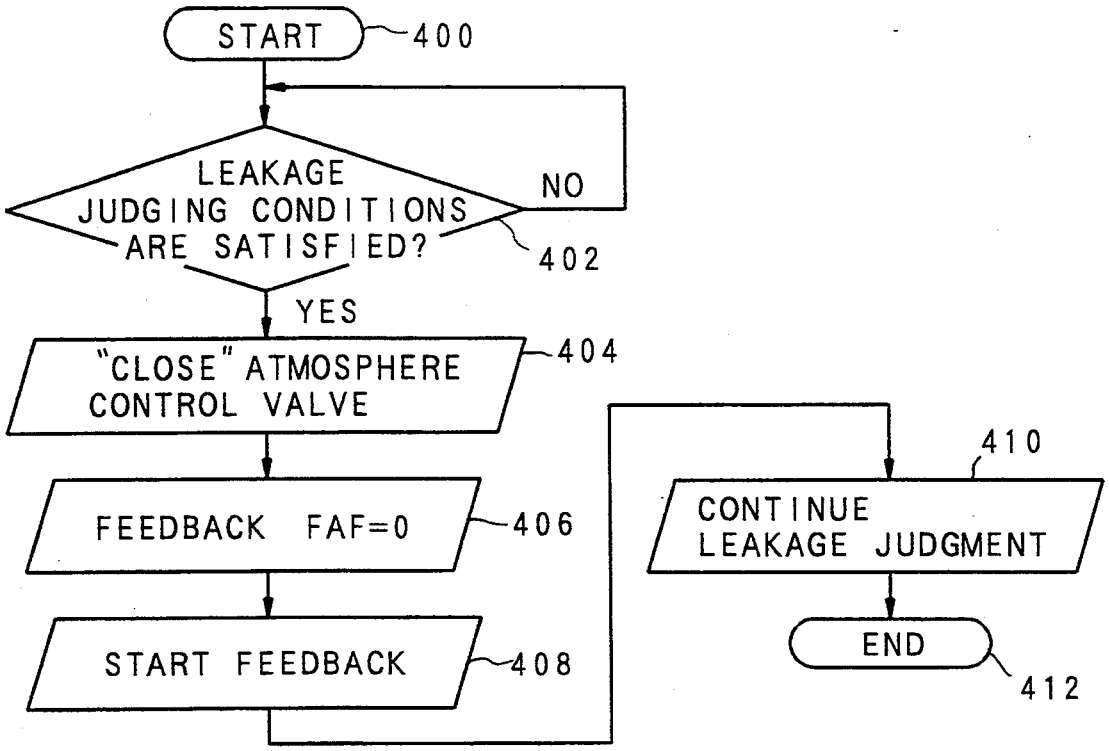
FIG. 7 is a flowchart for control of the air-fuel ratio control apparatus showing an embodiment of the invention.
Figure 8:
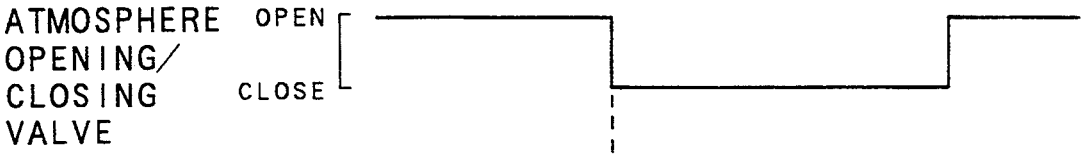
FIGS. 8(*a*) to 8(*c*) are timing charts showing the relation among the atmosphere opening/closing valve upon leakage judgment, the air-fuel ratio feedback value, and the air-fuel ratio.
Figure 8:
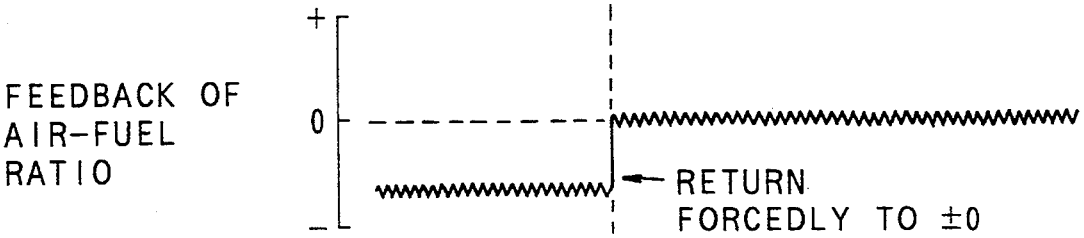
Figure 8:
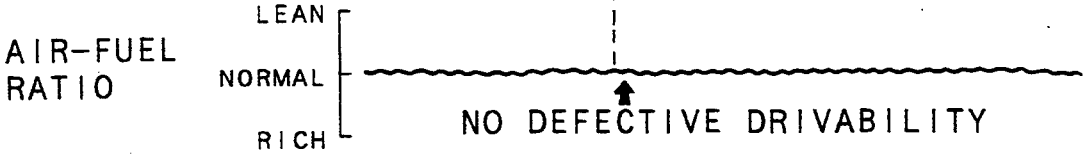
Figure 9:
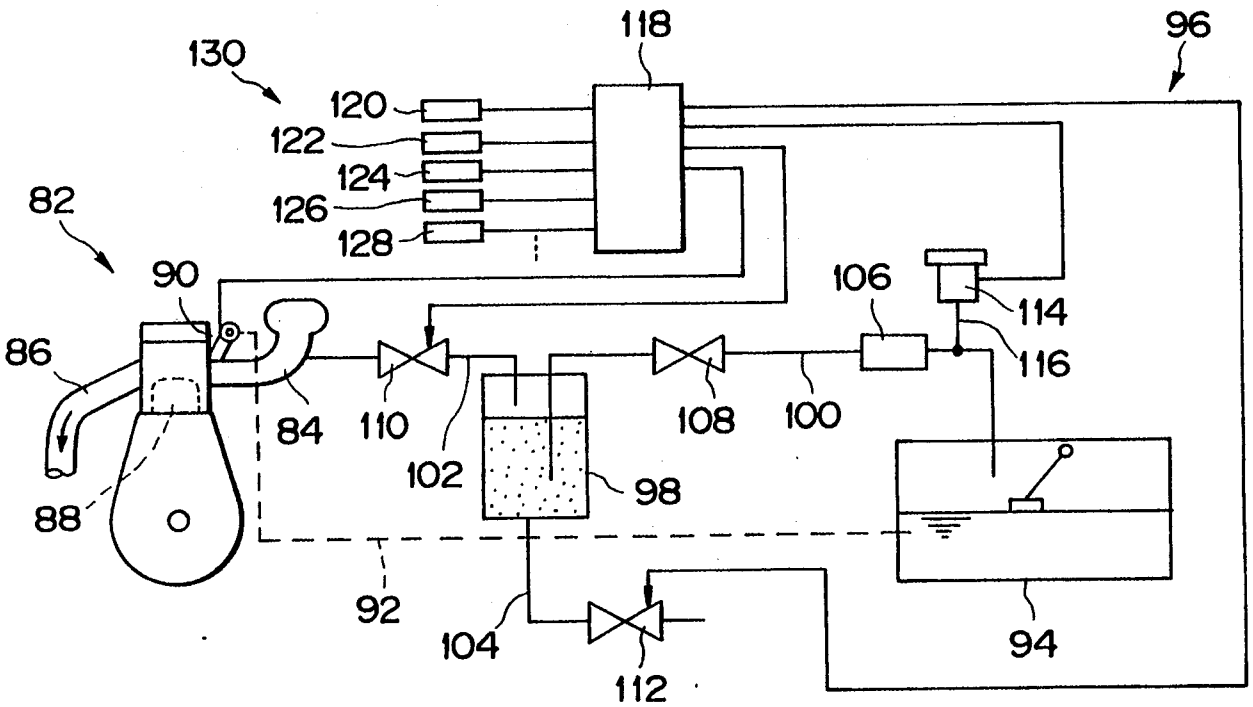
FIG. 9 is a schematic constructional diagram of the air-fuel ratio control apparatus.

FIGS. 7 to 9 show a third embodiment of the invention.

In FIG. 9, reference numeral 82 denotes an internal combustion engine which is installed in a vehicle (not shown); 84 an intake passage; 86 an exhaust passage; and 88 a combustion chamber. One end of the intake passage 84 communicates with an air cleaner (not shown) and the other end communicates with the combustion chamber 88. One end of the exhaust passage 86 communicates with the combustion chamber 88 and the other end is opened to the atmosphere.

The internal combustion engine 82 has a fuel injection valve 90 as a fuel system. A fuel injection valve 90 communicates with a fuel tank 94 by a fuel passage 92 and injects and supplies the fuel into the internal combustion engine 82.

The internal combustion engine 82 as an evaporating system has an evaporation fuel control apparatus 96. The evaporation fuel control apparatus has a canister 98 to adsorb and hold the evaporated fuel. The canister 98 communicates with the fuel tank 94 by an introducing passage 100 and also communicates with the intake passage 84 by a discharge passage 102. An atmosphere passage 104 communicates with the canister 98.

A separator 106 to separate the liquid fluid and a pressure adjustment valve 108 to adjust the pressure on the fuel tank 94 side are provided in the introducing passage 100. A purge control valve 110 is provided in the discharge passage 102.

The evaporation fuel control apparatus 96 has an atmosphere opening/closing valve 112 and a pressure sensor 114. The atmosphere opening/closing valve 112 is provided in the atmosphere passage 104. The pressure sensor 114 communicates with the discharge passage 102 through a pressure introducing passage 116 in order to detect the pressure in passage 102 between the fuel tank 94 and the purge control valve 110.

The fuel injection valve 92, purge control valve 110, atmosphere opening/closing valve 112, and pressure sensor 114 are connected to a control section 118 constituting a control means. An $O_2$ sensor 120 as an exhaust sensor is provided in the exhaust passage 86, a rotational speed sensor 122 to detect engine rotational speed, a pressure sensor 124 to detect negative intake pressure, a throttle sensor 126 to detect opening degree of a throttle valve (not shown), a cooling water temperature sensor 128 to detect the temperature of the cooling water, and other various kinds of sensors are connected to the control section 118.

The control section 118 judges the permission or inhibition of the purge of the evaporated fuel on the basis of detection signals from those various kinds of sensors 120 to 128 and opens or closes the purge control valve 110 by a duty control in accordance with an operating state of the internal combustion engine 82, thereby purging the evaporated fuel adsorbed and held in the canister 98 into the intake passage 84.

Figure 10:
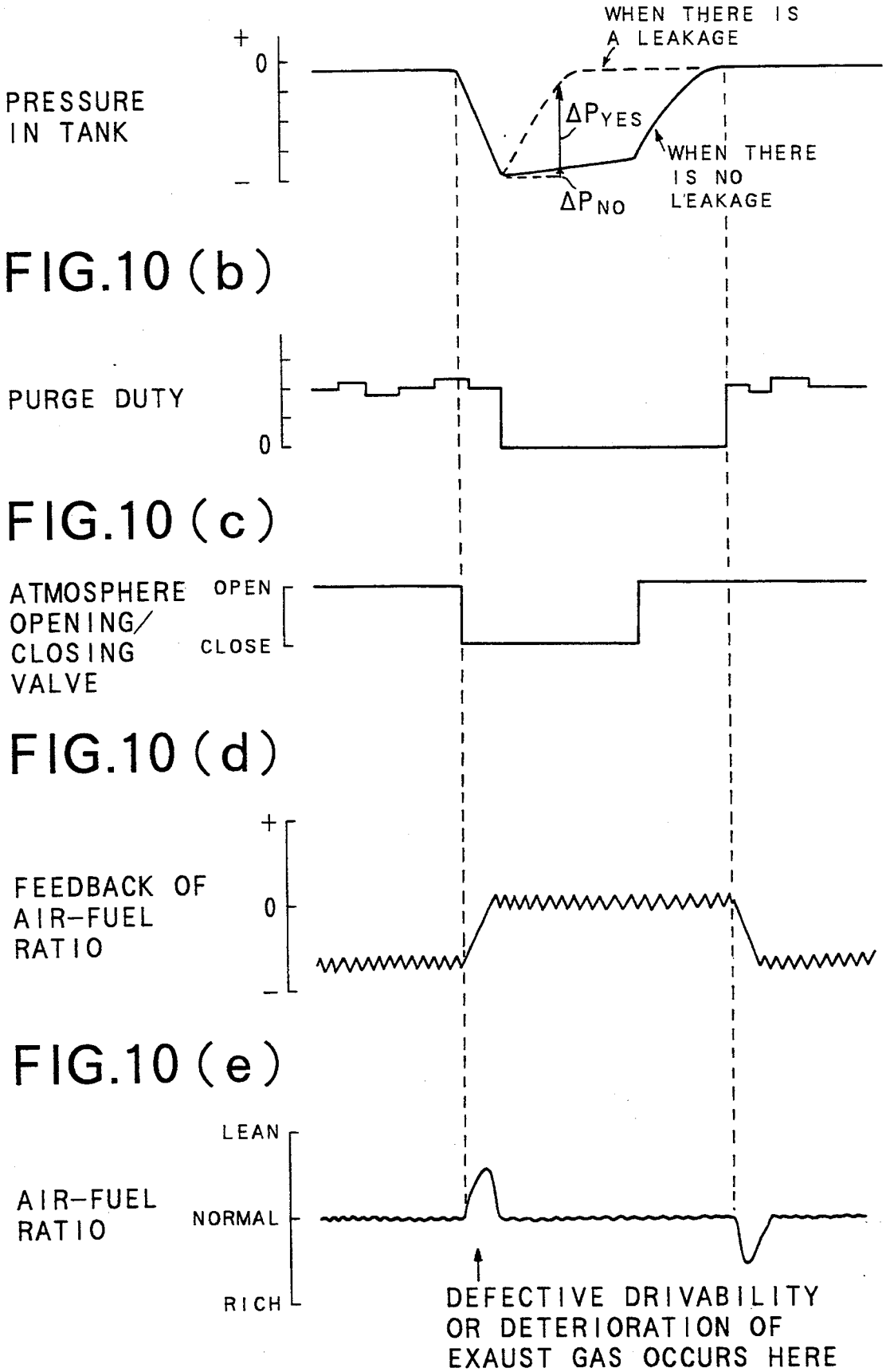
FIG. 10 represents prior art wherein FIG. 10(*a*) is a diagram showing a fluctuation of tank inner pressure, FIG. 10(*b*) is a diagram showing purge duty, FIG. 10(*c*) is a diagram showing the opening/closing state of the atmosphere opening/closing valve, FIG. 10(*d*) is a diagram showing the air-fuel ratio feedback state, and FIG. 10(*e*) is a diagram showing the rich/lean state of the air-fuel ratio.

When the leakage judging conditions are satisfied, as shown in FIGS. 10(*a*) to 10(*c*), the control section 118 closes the atmosphere opening/closing valve 112, opens the purge control valve 110, introduces the negative intake pressure of the intake passage 84 to the fuel tank 94 side, and sets the pressure in the fuel tank 94 to a negative pressure state of a specified value. After that, the control section 118 closes the purge control valve 110, holds the fuel tank 94 side upstream of the purge control valve 110 in a negative pressure state and detects the pressure $\Delta P$ in the fuel tank 94 in a predetermined time by the pressure sensor 114, thereby judging a leakage by a change in state of the pressure $\Delta P$ which is detected by the pressure sensor 114.

The internal combustion engine 82 having the evaporation fuel control apparatus 96 is provided with an air-fuel ratio control apparatus 130. The air-fuel ratio control apparatus 130 is constructed by the fuel injection valve 92, control section 118, $O_2$ sensor 120, and other various kinds of sensors 122 to 128.

The air-fuel ratio control apparatus 130 calculates an air-fuel ratio feedback value on the basis of the detection signal of the $O_2$ sensor 120 and makes the fuel injection value 92 as a fuel system operative by the air-fuel ratio feedback value and performs a feedback control so that the air-fuel ratio is set to a target value.

The control section 118 in this embodiment accordingly includes purge control means and leakage judging means of the evaporation fuel control apparatus 96 and air-fuel ratio control means of the air-fuel ratio control apparatus 130 and controls parts of the evaporation fuel control apparatus 96 and air-fuel ratio control apparatus 130.

In the air-fuel ratio control apparatus 130 of the internal combustion engine 82 having such an evaporation fuel control apparatus 96, the control section 118 calculates an air-fuel ratio feedback value on the basis of the detection signal of the $O_2$ sensor 120 and executes a feedback control so that the air-fuel ratio is set to a target value. The control section 118 also returns the air-fuel ratio feedback value to a reference value simultaneously with the closing operation of the atmosphere opening/closing valve 112 when the leakage judgment is executed by the evaporation fuel control apparatus 96 and performs a feedback control so that the air-fuel ratio is set to a target value.

The operation of this embodiment will now be described.

When the internal combustion engine 82 stops, the purge control valve 110 is closed, thereby closing the discharge passage 102. The evaporated fuel which occurs in the fuel tank 94 is, consequently, introduced into the canister 98 by the introducing passage 100 and is adsorbed and held.

In the operation of the internal combustion engine 82, the control section 118 which receives the detection signals from the various kinds of sensors 120 to 128 opens or closes the purge control valve 110, thereby purging the evaporated fuel adsorbed and held in the canister 98 into the intake passage 84. When the leakage judging conditions are satisfied, the control section 118 closes the atmosphere opening/closing valve 112 and opens the purge control valve 110, thereby introducing the negative intake pressure of the intake passage 84 to the fuel tank 94 side. After that, the purge control valve 110 is closed, thereby judging the leakage by a change $\Delta P$ in pressure which is detected by the pressure sensor 114. The control section 118 calculates the air-fuel ratio feedback value on the basis of the detection signal of the $O_2$ sensor 120 and performs a feedback control so that the air-fuel ratio is set to a target value. The control section 118 also returns the air-fuel ratio feedback value to a reference value simultaneously with the closing operation of the atmosphere opening/closing valve 112 when the leakage judgment is executed by the evaporation fuel control apparatus 96 and performs a feedback control so that the air-fuel ratio is set to a target value.

The above control will now be described with reference to FIGS. 7 and 8.

As shown by FIG. 7, when the control is started (step 400), the control section 118 checks to see if the leakage judging conditions are satisfied or not (step 402). If NO in the judgment (step 402), the processing routine is returned and the discrimination regarding whether the leakage judging conditions are satisfied or not is repeated.

If YES in the judgment (step 402), the leakage judgment is started and the atmosphere opening/closing valve 112 is closed (step 404). Simultaneously with the closing operation of the atmosphere opening/closing valve 112, the air-fuel ratio feedback value FAF is returned to 0 as a reference value so that FAF =0 (step 406). The feedback control is started from the state of FAF =0 so that the air-fuel ratio is set to a target value (step 408).

Namely, while the feedback control of the air-fuel ratio is being executed in a state in which the evaporated fuel has been discharged into the intake passage 84, when the leakage judgment is started by the evaporation fuel control apparatus 96, the air-fuel ratio control apparatus 130 once forcedly returns the air-fuel ratio feedback value FAF to FAF =0 simultaneously with the closing operation of the atmosphere opening/-closing valve 112 by the leakage judgment and subsequently continues the feedback control so that the air-fuel ratio is set to a target value.

After the air-fuel ratio feedback value FAF is set to FAF =0 (step 406), the feedback control is started so that the air-fuel ratio is set to a target value (step 408) and continues the leakage judgment (step 410).

That is, the atmosphere opening/closing valve 112 is closed and the purge control valve 110 is opened, thereby introducing the negative intake pressure in the intake passage 84 to the fuel tank 94 side and setting the pressure in the fuel tank 94 to a negative pressure state of a specified value. After that, the purge control valve 110 is closed and the fuel tank 94 side of the purge control valve 110 is held in the negative pressure state. The pressure $\Delta P$ in the fuel tank 94 in a predetermined time is detected by the pressure sensor 114. A leakage is judged by a change of state of the pressure $\Delta P$ which is detected by the pressure sensor 114. In the judgment, when the change in pressure $\Delta P$ is large, it is determined that there is leakage. When the change in pressure $\Delta P$ is small, it is decided that there is no leakage.

When the result of the judgment regarding whether there is leakage or not is obtained by the continuation of the leakage judgment (step 410), the processing routine is finished (step 412).

As mentioned above, the air-fuel ratio control apparatus 130 of the internal combustion engine 82 having the evaporation fuel control apparatus 96 calculates the air-fuel ratio feedback value FAF on the basis of the detection signal of the $O_2$ sensor 120 by the control section 118 and executes a feedback control so that the air-fuel ratio is set to a target value.

The air-fuel ratio control apparatus 130 once forcedly returns the air-fuel ratio feedback value FAF to 0 (FAF =0) as a reference value by the control section 118 synchronously with the closing operation of the atmosphere opening/closing valve 112 when the leakage judgment is performed by the evaporation fuel control apparatus 96 as shown in FIGS. 8(*a*) to 8(*c*). In a state in which the air-fuel ratio feedback value FAF is set to 0 (FAF =0) as a reference value, by restarting the feedback control so that the air-fuel ratio is set to the target value, it is possible to perform the feedback control so as to promptly trace the air-fuel ratio which is largely deviated to the lean side by closing the atmosphere opening/closing valve 112 so as to perform the leakage judgment.

Therefore, the air-fuel ratio control apparatus 130 can execute the feedback control so as to promptly trace the air-fuel ratio that is largely deviated to the lean side by closing the atmosphere opening/closing valve 112 in order to perform the leakage judgment. Thus, the fluctuation of the air-fuel ratio can be decreased and the fluctuation of the air-fuel ratio can be reduced, so that the deterioration of the drivability and the exhaust harmful component value can be prevented. There is also no need to increase the number of parts. By changing only the logic of the control section 118, the apparatus can cope with the invention. The invention can be advantageously performed in terms of cost.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an air-fuel ratio control apparatus of an internal combustion engine in which a canister to adsorb and hold evaporated fuel is provided in a supply passage which communicates an intake passage of the internal combustion engine and a fuel tank, an atmosphere opening/closing valve is provided so as to open said canister to the atmosphere, a purge valve is provided in the supply passage between said intake passage and said canister, a pressure sensor communicates with the supply passage between the canister and the fuel tank, and a control that closes said atmosphere opening/closing valve is closed when leakage is judged and reduces a pressure in the fuel tank to a predetermined negative pressure value, and thereafter closes said purge valve so that a leakage state of an evaporating system is discriminated, comprising the improvement wherein a fuel supply section is provided to supply the fuel to the internal combustion engine, and the control includes a control section for controlling in a manner such that when leakage judging conditions are satisfied, a preset promising correction amount is added to a fuel supply amount from said fuel supply section synchronously with the closing operation of said atmosphere opening/-closing valve to thereby reduce fluctuation of the air-fuel ratio when the leakage is judged.

2. An air-fuel ratio control apparatus according to claim 1, wherein the promising correction amount which is preset by an atmosphere temperature and is added to a fuel supply amount from said fuel supply section synchronously with the closing operation of said atmosphere opening/closing valve, and wherein the control section, after the promising correction amount is added to the fuel supply amount and controlled, controls the fuel supply amount so that said amount is gradually attenuated from the value added with the promising correction amount until the total fuel supply amount is less than a predetermined supply amount to thereby reduce fluctuation of the air-fuel ratio by the leakage judging operation.

3. In an air-fuel ratio control apparatus of an internal combustion engine in which a canister to adsorb and hold evaporated fuel is provided in a supply passage which communicates an intake passage of the internal combustion engine and a fuel tank, an atmosphere opening/closing valve is provided so as to open said canister to an atmosphere, a purge valve is provided in the supply passage between said intake passage and said canister, a pressure sensor communicates with the supply passage between the canister and the fuel tank, and a control that closes said atmosphere opening/closing valve when a leakage is judged and reduces a pressure in the fuel tank to a predetermined negative pressure value, and thereafter said purge valve is closed and a leakage state of an evaporating system is discriminated, comprising the improvement wherein the control is provided with a control section for controlling in a manner such that a feedback correction amount before the leakage judgment is started is stored and, at the end of said leakage judgment, the correction amount is returned to the stored feedback correction amount before the start of the leakage judgment.

4. In an air-fuel ratio control apparatus of an internal combustion engine in which a canister to adsorb and hold evaporated fuel is provided in a supply passage which communicates an intake passage of the internal combustion engine and a fuel tank, an atmosphere opening/closing valve is provided so as to open said canister to an atmosphere, a purge valve is provided in the supply passage between said intake passage and said canister, a pressure sensor communicates with the supply passage between the canister and the fuel tank, and a control that closes said atmosphere opening/closing valve when a leakage is judged and reduces a pressure in the fuel tank to a predetermined negative pressure value, and thereafter said purge valve is closed and a leakage state of an evaporating system is discriminated, comprising the improvement wherein there is provided a control section for controlling in a manner such that when leakage judging conditions are satisfied, a mean value of a feedback correction amount in a predetermined time before the closing operation of said atmosphere opening/closing valve is calculated and stored and, at the end of the leakage judgment, the feedback correction amount is forcedly set to said mean value.

5. In an air-fuel ratio control apparatus of an internal combustion engine having an evaporation fuel control apparatus which has a canister that communicates with a fuel tank of the internal combustion engine through an introducing passage and communicates with an intake passage of said internal combustion engine through a discharge passage, a purge control valve is provided in the discharge passage, an atmosphere opening/closing valve is provided in an atmosphere passage for communicating the canister with the atmosphere, and a pressure sensor for detecting pressure on the fuel tank side of said purge control valve and which is constructed in a manner such that the purge control valve is opened or closed in accordance with an operating state of the internal combustion engine, evaporated fuel in the canister is discharged to the intake passage, and when leakage judging conditions are satisfied, said atmosphere opening/closing valve is closed, the purge control valve is opened, a negative intake pressure of said intake passage is introduced to the fuel tank side, and thereafter the purge control valve is closed, and a leakage is discriminated by a change in pressure that is detected by said pressure sensor, comprising the improvement wherein there is provided control means for controlling in a manner such that an air-fuel ratio feedback value is calculated on the basis of a detection signal of an exhaust sensor provided in the exhaust passage, a feedback control is performed so as to set an air-fuel ratio to a target value, and simultaneously with the closing operation of the atmosphere opening/closing valve when the leakage judgment is executed by said evaporation fuel control apparatus, a feedback control is performed so that the air-fuel ratio is set to a target value by returning said air-fuel ratio feedback value to a reference value.

* * * * *